US005778981A

United States Patent [19]

Head

[11] Patent Number: 5,778,981

[45] Date of Patent: Jul. 14, 1998

[54] DEVICE FOR SUSPENDING A SUB SEA OIL WELL RISER

[76] Inventor: Philip Head, No. 6 Leith Mansions, Grantully Road, London W9 1LQ, Great Britain

[21] Appl. No.: 688,090

[22] Filed: Jul. 29, 1996

[51] Int. Cl.[6] ..... E21B 7/132

[52] U.S. Cl. ..... 166/345; 166/350; 166/367; 166/77.2; 405/224.3; 405/205

[58] Field of Search ..... 166/345, 344, 166/350, 367, 77.2; 405/205, 224, 224.2, 224.3, 200, 195.1

[56] References Cited

U.S. PATENT DOCUMENTS

| | | | |
|---|---|---|---|
| 2,783,027 | 2/1957 | Gilbert | 166/350 X |
| 4,240,506 | 12/1980 | Dareing | 166/367 |
| 4,735,267 | 4/1988 | Stevens | 166/350 X |
| 4,799,827 | 1/1989 | Jaqua | 166/350 X |
| 4,906,139 | 3/1990 | Chiu et al. | 405/224.3 X |
| 4,995,762 | 2/1991 | Goldman | 405/224 X |
| 5,069,580 | 12/1991 | Herwig et al. | 405/191 |
| 5,671,811 | 9/1997 | Head | 166/350 X |

FOREIGN PATENT DOCUMENTS 2 297 104 7/1996 United Kingdom .

*Primary Examiner*—Roger J. Schoeppel
*Attorney, Agent, or Firm*—Herbert Dubno; Yuri Kateshov

[57] ABSTRACT

The invention relates to a guide arrangement 1 for a riser assembly 10 including a length of a second riser tube 6 running from a well head 2 to a surface vessel 6. First buoys 8 are provided which permit the evacuation and refilling of water to adjust the buoyancy effect and comprise a system to admit a controlled amount air or water and which are connected to the lower end of the riser assembly 10 by a first line 14 via a pulley 16 such that as the first buoys are raised the riser assembly 10 is pulled downwards towards the well head. Second buoys are provided to form a rigid frame work for the guide arrangement 1 when air has replaced the water contained therein. Support buoys 22 are connected to the first and second riser tubes 4, 8 by air line tubes 13 which enable air to be removed from and added to the support buoys 22 to adjust the amount of buoyancy they provide.

7 Claims, 4 Drawing Sheets

DEVICE FOR SUSPENDING A SUB SEA OIL WELL RISER

FIELD OF THE INVENTION

This invention relates to accessing a sub sea oil production well. Such access is required for a number of reasons for example to take further measurements of the reservoir by introducing logging devices, for servicing or installation of electric submersible pumps to enhance production rates or for many other reasons.

BACKGROUND OF THE INVENTION

Typically for a sub sea production well the original drilling platform will have been removed and the well head will have to be accessed by means of a suitable surface vessel. In order that the required operations can be carried out to the well it is necessary that the movement of the vessel which is floating on the surface of the sea is compensated for to ensure positional consistency with respect to the well itself which is fixed on the sea bed. This is conventionally provided by means of a heave compensation system on the vessel itself which is extremely cumbersome and expensive.

By means of the invention a method and apparatus has been devised which provides positional consistency between the well head and the vessel without the need for an expensive heave compensation system on the vessel. The apparatus and method according to the invention also ensures that there is no damage caused to the well head by bending moments applied by movement of the piping connecting it to the surface vessel.

Traditionally the outer tubing for intervention purposes has been approximately 7 inches in diameter which is necessary to carry out operations which require tool strings and other equipment which necessarily have a diameter of approximately 7 inches. This outer tubing is called a riser and is conventionally made of jointed sections. Coiled tubing on the other hand is only available at a maximum diameter of 4.5 inches and it is therefore not possible to use continuous coiled tubing as the riser because it has insufficient diameter to contain the tool string and equipment and therefore carry out well intervention operations which require the use of tool strings and equipment having a diameter greater than 4.5 inches.

There are a number of disadvantages to the use of a jointed riser. These are that the surface vessel has to be located and anchored accurately above the well head, this can be a very time consuming operation. It will be appreciated that in well intervention operations a large proportion of the cost arises from the hire charges, or lease charges, or cost of capital whatever the financial arrangement, of the expensive capital equipment as well as the labour cost off shore. The time spent carrying out the required operations has therefore a critical effect on costs. In addition to the task of accurately anchoring the surface vessel it is also necessary to include heave compensation systems to compensate for the movement of the relatively fixed riser and the surface vessel which will rise and fall with the swell of the sea.

OBJECTS OF THE INVENTION

It is the purpose of the invention to enable such well intervention operations to be carried out using lower diameter coiled tubing as the riser instead of the existing methods of using jointed tubing.

It is also the purpose of this invention to provide a means of speedily deploying a conventional riser assembly arranged on the end of a coiled tubing connector to the surface.

SUMMARY OF THE INVENTION

According to the invention there is provided a guide arrangement for a riser assembly which is intended to be fixedly connected at one end to a well head, in which the guiding arrangement comprises at least one buoy comprising a chamber which contains a relatively heavy fluid such as water and is capable of being evacuated of the relatively heavy fluid which is replaced by a relatively lighter fluid such as air, wherein the at least one buoy is connected to one end of a first line which passes through a pulley and is connected to the riser assembly, said pulley being located such that upwards movement of the at least one buoy causes downward movement of the riser assembly. The pulley is preferably fixed to the well head.

According to a preferred aspect of the invention of the guide arrangement comprises at least one second line extending from the well head to at least one second buoy, preferably the at least one second line passes through a guide part of the riser assembly.

Preferably the at least one first buoy is slidably connected to the at least one second line to retain the buoy to the guide arrangement whilst permitting the at least one first buoy to rise and fall relative to the guide arrangement.

The at least one first line is also preferably connected to an intermediate slide member which is sidably connected to the at least one second line and acts against the riser assembly to cause the riser assembly to be pulled downwardly as the at least one first buoy rises.

According to a further preferred aspect of the invention the guide arrangement comprises two first or second buoys arranged diametrically opposed to each other and forming the access for the riser head arrangement between them. The two second buoys may be connected together by means of an open frame which forms an access space for the riser head arrangement.

Alternatively the guide arrangement according to the invention may comprise four first or second buoys arranged diametrically opposed to each other and forming the access for the riser head arrangement between them. The four second buoys may be connected together by means of an open frame which forms an access space for the riser head arrangement.

According to the invention the guide arrangement and riser assembly form an apparatus comprising a coiled tubing wherein the coiled tubing and support buoys are adjusted to ensure the desired profile of the coiled tubing necessary for the ready transmission of equipment and instruments down the coiled tubing to the well such that the bending of coiled tubing automatically accounts for the ocean heave avoiding the requirement for a heave compensation system.

The apparatus for accessing a sub sea well preferably comprises a surface vessel.

Preferably the support buoys have adjustable buoyancy by evacuation or filling of the buoys which is controlled remotely from the surface vessel to maintain the coiling tubing of the continuous riser in a smooth continuous curve.

The support buoys also comprise pressure sensors which relay information on the condition and position of the support buoys to the surface vessel.

Preferably the riser assembly comprises a length of continuous coiled tubing and a riser head assembly connected to one end of the coiled tubing, which is intended to be fixedly connected at one end to a well head, and the other end of the coiled tubing being arranged on a surface vessel, wherein the coiled tubing has a counter weight attached thereto in the region of the end which is attached to the surface vessel which applies a downward force on the coiled tubing to ensure that the coiled tubing is extending in a vertical direction in the region of the vessel.

The preferred method of accessing a well head with coiled tubing according to the invention comprises the following steps;

1. Connection of the first lines of the guide arrangement and riser assembly between the first buoy and riser head arrangement though a pulley.
2. Attaching the pulley to the well head.
3. Evacuating at least part of the first buoy causing the first buoy to rise and pulling down the riser assembly towards the well head.

Preferably at step 1 the pulley is initially arranged together with the riser assembly and before the pulley is attached to the well head (step 2). it is lowered down to the well head away from the riser assembly by lowering the first buoy (by replacing a lighter fluid contained therein by a heavier fluid).

In addition the method preferably comprises that:

at least one second line is attached between the well head and at least one second buoy, and evacuating at least part of said second buoy to allow it rise which induces tension in the second line and provides a rigid support in the aligned position for the connection of the said riser head arrangement to the well head.

BRIEF DESCRIPTION OF THE DRAWING

There is now described detailed embodiments of the invention, in which the continuous coiled is shown by way of example only as coiled tubing, with reference to the accompanying drawing in which.

SPECIFIC DESCRIPTION

Figure 1:
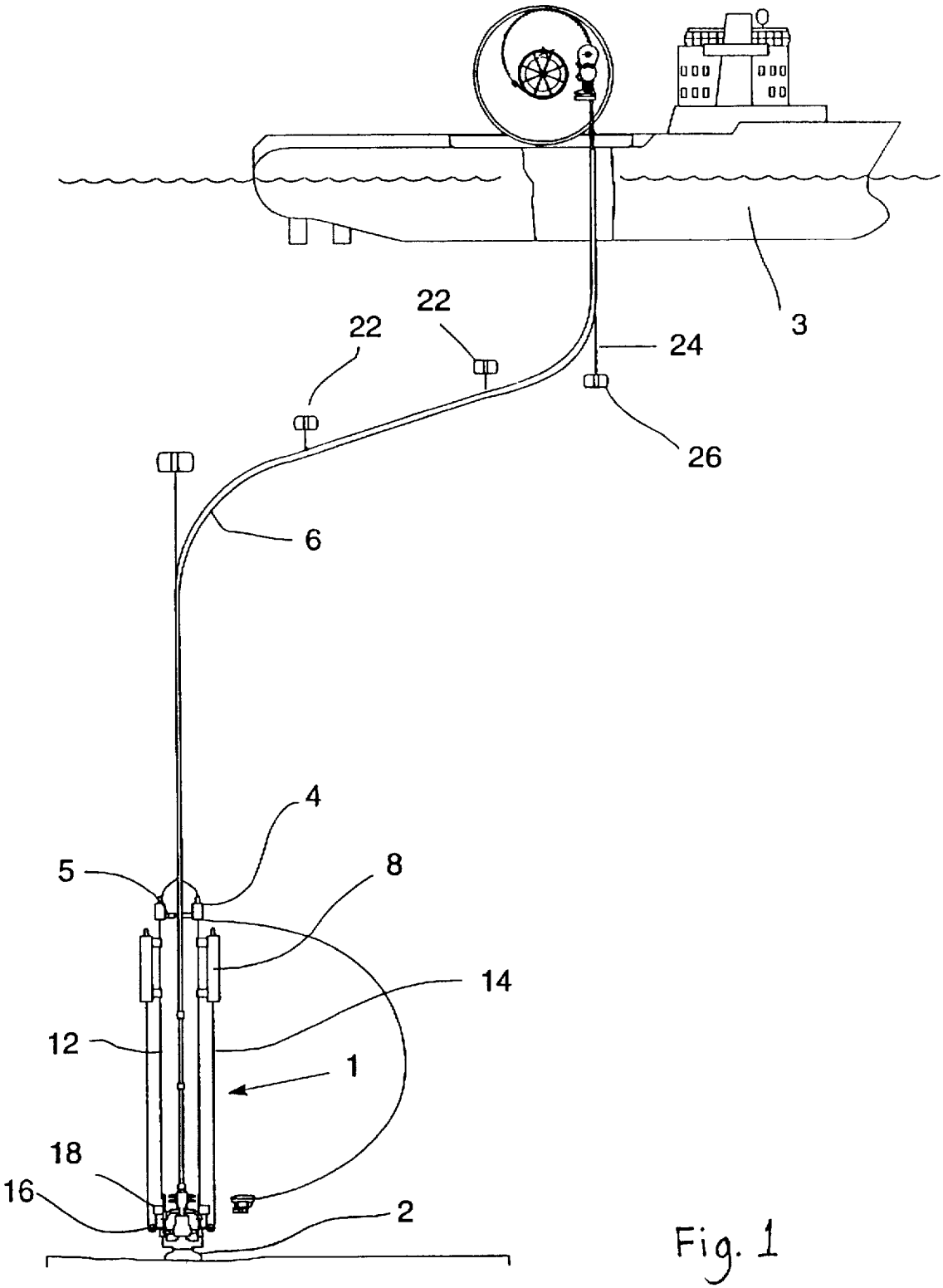
FIG. 1 is a cross sectional view of the guide arrangement according to an embodiment of the invention in the installed position.
Figure 2:
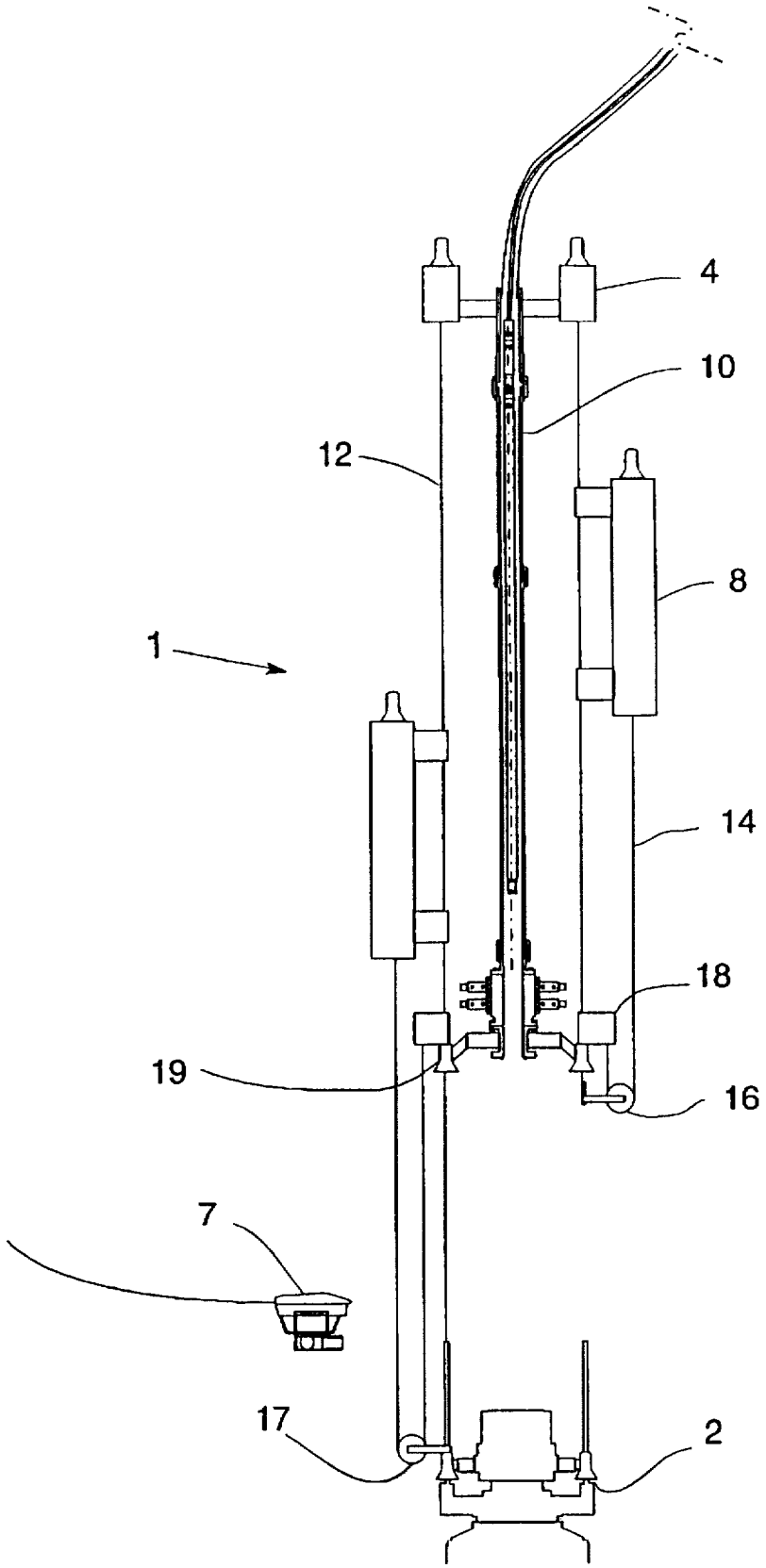
FIG. 2 is cross sectional view of the guide arrangement in a first stage of assembly.
Figure 3:
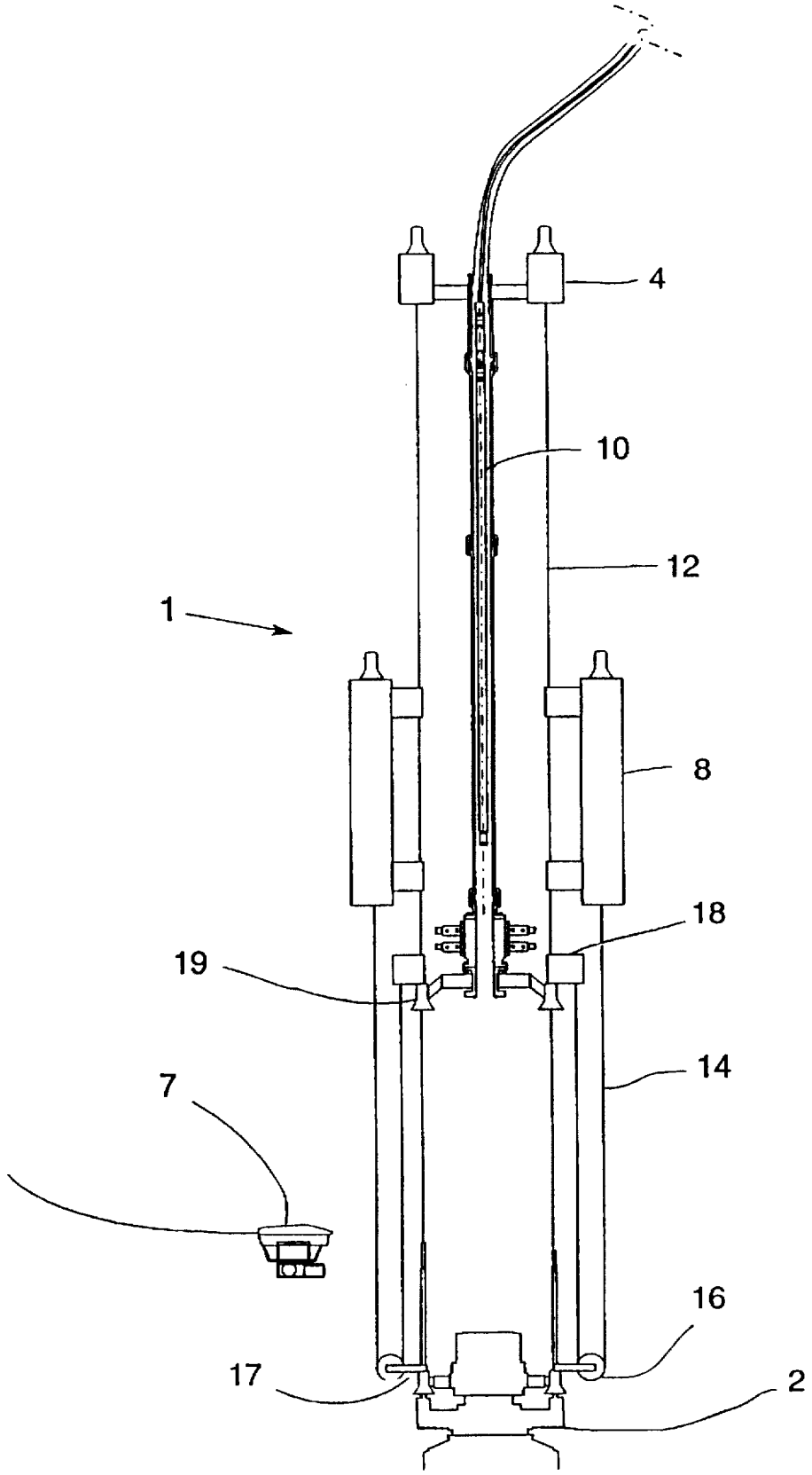
FIG. 3 is a cross sectional view of the guide arrangement of FIG. 2 showing a second stage of assembly.
Figure 4:
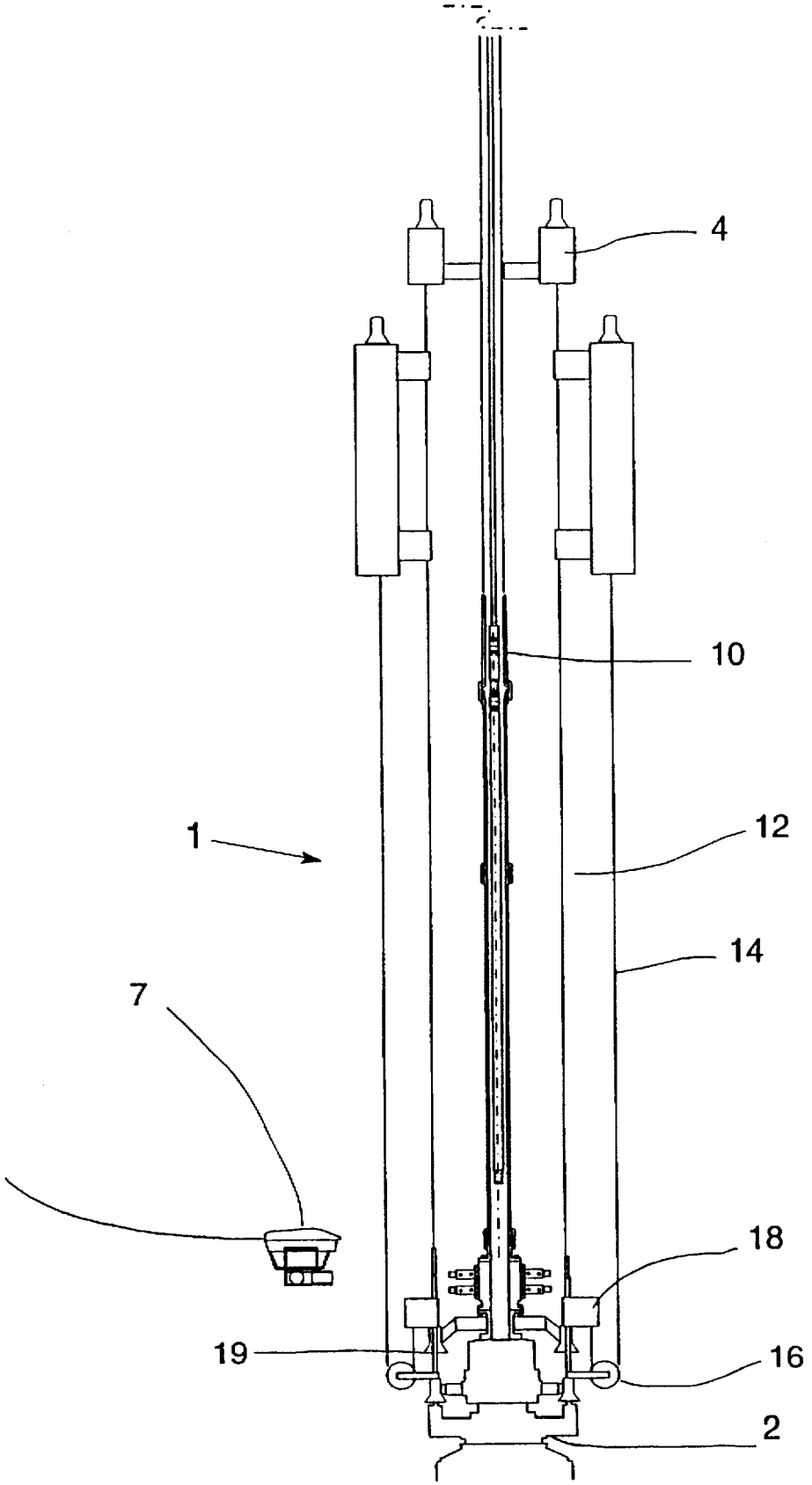
FIG. 4 is a cross sectional view of the guide arrangement of FIG. 2 showing a third stage of assembly.

Referring to FIG. 1 the guide arrangement 1 comprises support buoys 4 a connecting frame 5 and support lines 12 extending from the lower end of the buoys 4. The guide arrangement is lowered from a surface vessel 3 and when it is in position a remote vehicle 7 is used to connect the lines 12 to the well head 2. When the guides lines are connected the buoys 4 can be evacuated which means that the water contained in side is pumped out and replaced by air as shown in FIG. 1. This causes the buoys to rise and induces significant tension in the lines 12 such that a rigid structure is produced which acts as a guide for the access of the riser tube assembly 1. Referring to FIG. 2 it can be seen that the riser tube assembly is guided to the access provided by the open frame 5 of the buoys 4 the riser head assembly needs to be pulled down into position ready to be attached to the well head 2 for well intervention operations to commence. It can be seen by the person skilled in the art that by this means very simple and cheap access to the well head is provided for a coiled tubing riser.

The guiding arrangement 1 also comprises at least one buoy 8 fillable with water and capable of being evacuated of the water which is replaced by air which is connected to one end of a further line 14 which passes through a pulley 16 and is connected to the riser assembly 10. the pulley 16 is located such that upwards movement of the buoy 8. when it is evacuated causes downward movement of the riser assembly 1 towards its desired position at the well head. The pulley 16 is preferably fixed to the well head 2.

The buoy 8 is slidably connected to the support line 12 to permit the buoy 8 to rise and fall relative to the guide arrangement 1.

The further line 14 is also preferably connected to an intermediate slide member 18 which is slidably connected to the support line 12 and acts against the riser assembly 10 to cause the riser assembly 10 to be pulled downwardly as the buoy 8 rises.

The support buoys 4 may be arranged as a pair arranged diametrically opposed to each other and forming the access for the riser head assembly between them. The two support buoys 4 may be connected together by means of an open frame 5 which forms an access space for the riser head assembly 10.

Alternatively the guide arrangement 1 may comprise four support buoys 4 arranged diametrically opposed to each other and forming the access for the riser head assembly 10 between them. The four support buoys may be connected together by means of an open frame 5 which forms an access space for the riser head assembly 10.

The method of accessing a well head with coiled tubing according to the invention comprises the following steps;

1. Referring to FIG. 2 the lines 14 of the guide arrangement 1 are connected between the buoy 4 and the riser head assembly 10 though a pulley 16.
2. The pulley 16 is then lowered to the well head 1 as shown by the pulley 16 on the left hand side of the guide arrangement of FIG. 2. This lowering occurs by ballasting the buoy 14 i.e. replacing air for water in the buoy so that the weight of the buoy and the pulley causes it to fall to the well head. The pulley has suitable attaching means 17 to locate on the well head.
3. Simultaneously the support line is attached between the well head and the support buoy 4 through line guides 19 of the riser assembly 10. The pulley 16 on the right hand side of the guide arrangement of FIG. 2 is then also lowered to the well head.
4. Evacuating at least part of support buoy 4 to allow it rise inducing tension in the support line 12 and providing a rigid support in the aligned position for the connection of the said riser head assembly 10 to the well head 2.
5. Evacuating at least part of the buoy 8 causing it to rise and pulling down the riser assembly 10 towards the well head 2. The line 14 is connected to an intermediate slide member 18 which is slidably engaged on the support line 12 above the line guide 19 of the riser assembly 10 so that the intermediate slide member 18 acts on the line guide 19 to pull down the riser assembly 10.

Referring to FIG. 1 it can be seen that a number of riser support buoys 22 are provided each of which comprise a chamber which is capable of being evacuated and refilled. The riser support buoys 22 are connected to the riser assembly 1 and the coiled tubing riser 6 which leads from the riser assembly to the surface vessel 3 by means of lines 24 at intermittent points along the coiled tubing riser 6 between the riser head assembly arrangement 1 and the vessel 8. By this means the profile of the coiled tubing can be controlled so that it provides an even incline which will permit the easy flow of the required equipment and instrumentation down to the well head. The coiled tubing is also made sufficiently long and allowed to bend with the movement of the heave of the sea or ocean which avoids the need for a heave compensation system on the vessel itself The support buoys 22 are adjusted by means of evacuation and/or refilling to ensure the desired profile of the coiled tubing 6.

It is necessary that the coiled tubing riser 6 exits from the vessel 3 in a vertical direction and to ensure that this is the case a special weighted buoy 26 is provided which comprises a heavy weight to counteract the lateral forces acting on the coiled tubing riser to such an extent that a sufficient vertical section of the coiled tubing riser 6 at the end which connects to the vessel 3 is ensured.

Referring again the guide arrangement 1 the buoyancy effect of the evacuated support buoys 4 has the effect of providing a tensile stress throughout the well head 2 and riser assembly 1 which provides it with a resilience to bending forces. It is these bending forces which are the main danger because they cause the flanged seals in the whole system to leak. It is estimated that each cubic meter of evacuated volume within the riser buoys 4 will provide a vertical upward force on the well head riser assembly of one tonne.

The above embodiment describes the invention as applied to coiled tubing by way of example only and it will be appreciated by the person skilled in the art that the invention could just as easily be applied to a joined tube system.

What is claimed is:

1. A device for accessing a sub-sea well comprising:

a surface vessel floating on the surface of the sea;

a well head of a sub-sea well on the sea bed; and guide means for transporting equipment between the well head and the vessel, said guide means comprising:

a continuous coiled tubing extending between said well head and vessel and having an upper end which is attached to the vessel and a lower end, said tubing defining a transport path for the equipment, riser means along the transport path for interconnecting the well head and tubing and adapted to apply a tensile stress to the lower end of the tubing upon connecting with the head, so that the lower end of the tubing extends along a substantially vertical stretch of said transport path, and a plurality of spaced apart support buoys attached to the tubing between said upper and lower ends at such locations as to form a smooth continuous curved stretch of said tubing.

2. The device defined in claim 1 wherein said one riser means comprises:

a pulley operatively connected with the lower end of said tubing;

a first line passing through the pulley and having opposite line ends, a first buoy connected with one of the line ends, respective ballast means in said first buoy for replacing a relatively heavy medium in the first buoy with a relatively light medium, said first buoy and said tubing being displaceable in opposite directions upon replacing said heavy medium with the light medium thereby providing connection between said lower end of the tubing and the well head.

3. The device defined in claim 2 wherein said riser means comprises a second buoy connected with said tubing above the first buoy, and a second line connecting said second buoy with the well head and passing through a line guide which is operatively connected with the other end of the first line and through the first buoy, so that said first buoy is movable vertically relative to said tubing.

4. The device defined in claim 3 wherein said second buoy is formed with respective ballast means for displacing a relatively heavy medium with a relatively light medium.

5. The device defined in claim 3 further comprising another second buoy arranged symmetrically opposite the first mentioned second buoy and forming an access to said well head between said second buoys.

6. The device defined in claim 1 wherein said well head is formed with at least one receiving means for locking the riser means with said well head.

7. The device defined in claim 1 further comprising a weight attached to said coiled tubing along said transport path in the vicinity of the upper end of said tubing for generating a downward force, so that said tubing is formed with another vertical stretch in the vicinity of the upper end thereof and immediately upstream from said smooth curved stretch.

* * * * *